US011846035B2

(12) United States Patent
Seki et al.

(10) Patent No.: US 11,846,035 B2
(45) Date of Patent: Dec. 19, 2023

(54) PLATING APPARATUS AND PLATING METHOD

(71) Applicant: EBARA CORPORATION, Tokyo (JP)

(72) Inventors: Masaya Seki, Tokyo (JP); Shao Hua Chang, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/667,348

(22) Filed: Feb. 8, 2022

(65) Prior Publication Data

US 2022/0267921 A1 Aug. 25, 2022

(30) Foreign Application Priority Data

Feb. 19, 2021 (JP) ..... 2021-025155

(51) Int. Cl.
*C25D 17/02* (2006.01)

(52) U.S. Cl.
CPC ..... *C25D 17/02* (2013.01)

(58) Field of Classification Search
None
See application file for complete search history.

(56) References Cited

U.S. PATENT DOCUMENTS 6,379,511 B1 * 4/2002 Fatula ..... C25D 17/10 204/222
2007/0144912 A1 * 6/2007 Woodruff ..... C25D 17/001 205/148
2016/0348263 A1 * 12/2016 Woodruff ..... C25D 17/002

FOREIGN PATENT DOCUMENTS

JP 2008-019496 A 1/2008
JP 2016-211010 A 12/2016

* cited by examiner

*Primary Examiner* — Louis J Rufo
(74) *Attorney, Agent, or Firm* — BakerHostetler

(57) ABSTRACT

Provided is a technique that allows suppressing a liquid splash of a plating solution. A plating apparatus includes a plating tank 10 including an inner tank 11, a substrate holder, and a paddle 50 configured to agitate the plating solution accumulated in the inner tank 11 by reciprocating in a horizontal direction. The paddle 50 is arranged to be inserted through a hole provided in an outer peripheral wall of the inner tank and to build a bridge between an inside of the inner tank and an outside of the inner tank, and the paddle 50 includes a first portion 51 configured to agitate the plating solution accumulated in the inner tank, a second portion 53 arranged outside the inner tank and disposed above the first portion, and a connecting portion 52 arranged outside the inner tank to connect the first portion to the second portion.

3 Claims, 5 Drawing Sheets

PLATING APPARATUS AND PLATING METHOD

TECHNICAL FIELD

The present invention relates to a plating apparatus and a plating method. This application claims priority from Japanese Patent Application No. 2021-025155 filed on Feb. 19, 2021. The entire disclosure including the descriptions, the claims, the drawings, and the abstracts in Japanese Patent Application No. 2021-025155 is herein incorporated by reference.

BACKGROUND ART

Conventionally, there has been known what is called a cup type plating apparatus as a plating apparatus that can perform a plating process on a substrate (for example, see PTL 1). Such a plating apparatus includes a plating tank that accumulates a plating solution and has an anode arranged in its inside, and a substrate holder that holds a substrate as a cathode.

PTL 2 is another prior art document related to this application. PTL 2 discloses a technique related to a paddle that agitates a plating solution accumulated in a plating tank.

CITATION LIST

Patent Literature

PTL 1: Japanese Unexamined Patent Application Publication No. 2008-19496

PTL 2: Japanese Unexamined Patent Application Publication No. 2016-211010

SUMMARY OF INVENTION

Technical Problem

In a plating apparatus as exemplified in PTL 1 above, a paddle, such as the one exemplified in PTL 2, can be considered to be installed in a plating tank such that the paddle extends in a horizontal direction to agitate a plating solution. However, in this case, the paddle may cause a wave on a liquid surface of the plating solution accumulated in the plating tank and thereby allow a liquid splash of the plating solution.

The present invention has been made in view of the above, and one of the objects of the present invention is to provide a technique that ensures suppressing a liquid splash of the plating solution.

Solution to Problem

[Aspect 1] To achieve the above-described object, a plating apparatus according to one aspect of the present invention includes a plating tank, a substrate holder, and a paddle. The plating tank is configured to accumulate a plating solution inside the plating tank. The plating tank includes an inner tank provided with an anode arranged inside the inner tank. The substrate holder is configured to hold a substrate as a cathode. The paddle is configured to agitate the plating solution accumulated in the inner tank by reciprocating in a horizontal direction. The paddle is arranged to be inserted through a hole provided in an outer peripheral wall of the inner tank and to build a bridge between an inside of the inner tank and an outside of the inner tank, and the paddle includes a first portion configured to agitate the plating solution accumulated in the inner tank, a second portion arranged outside the inner tank and disposed above the first portion, and a connecting portion arranged outside the inner tank to connect the first portion to the second portion.

With this aspect, compared with a case where the connecting portion and the second portion of the paddle are arranged inside the inner tank, for example, a wave on a liquid surface of the plating solution caused by the paddle can be suppressed when the paddle reciprocates. Therefore, a liquid splash of the plating solution can be suppressed.

[Aspect 2] In Aspect 1 described above, the plating tank may be a plating tank having a double tank structure further including an outer tank arranged outside the inner tank.

[Aspect 3] In Aspect 2 described above, the outer tank may be provided with a guiding member configured to guide a reciprocation of the second portion in the horizontal direction.

With this aspect, the paddle can easily be reciprocated smoothly in the horizontal direction.

[Aspect 4] To achieve the above-described object, a plating method according to one aspect of the present invention is a plating method using the plating apparatus according to any one of Aspects 1 to 3 described above, and includes reciprocating the paddle in the horizontal direction when performing a plating process on the substrate.

With this aspect, a liquid splash of the plating solution can be suppressed.

DESCRIPTION OF EMBODIMENTS

The following describes embodiments of the present invention with reference to the drawings. Furthermore, the drawings are schematically illustrated for ease of understanding features of matters, and a dimensional proportion and the like of each component is not always identical to that of an actual component. For some drawings, X-Y-Z orthogonal coordinates are illustrated for reference purposes. Of the X-Y-Z orthogonal coordinates, the Z direction corresponds to the upper side, and the −Z direction corresponds to the lower side (the direction where gravity acts).

Figure 1:
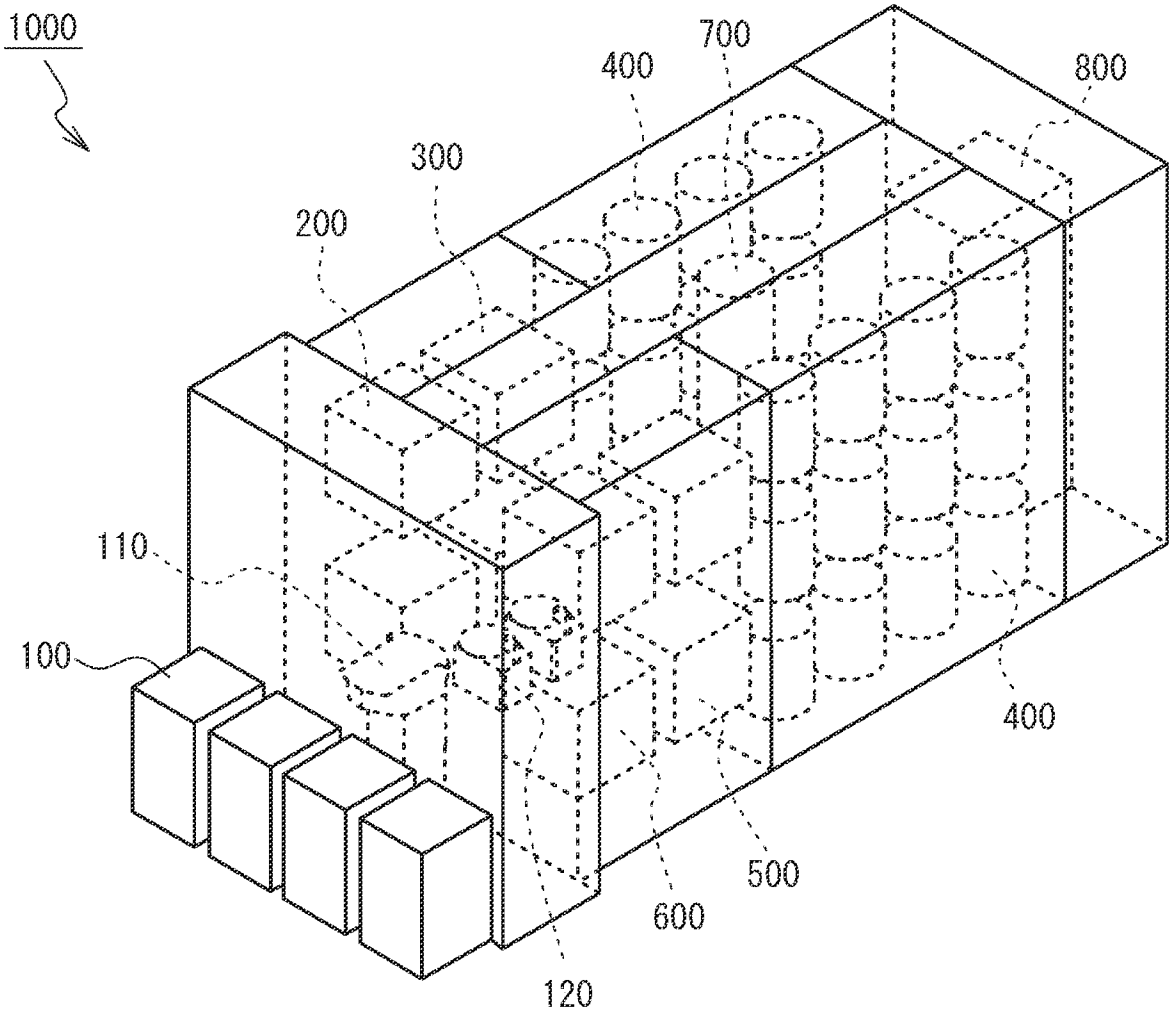
FIG. 1 is a perspective view illustrating an overall configuration of a plating apparatus according to an embodiment.
Figure 2:
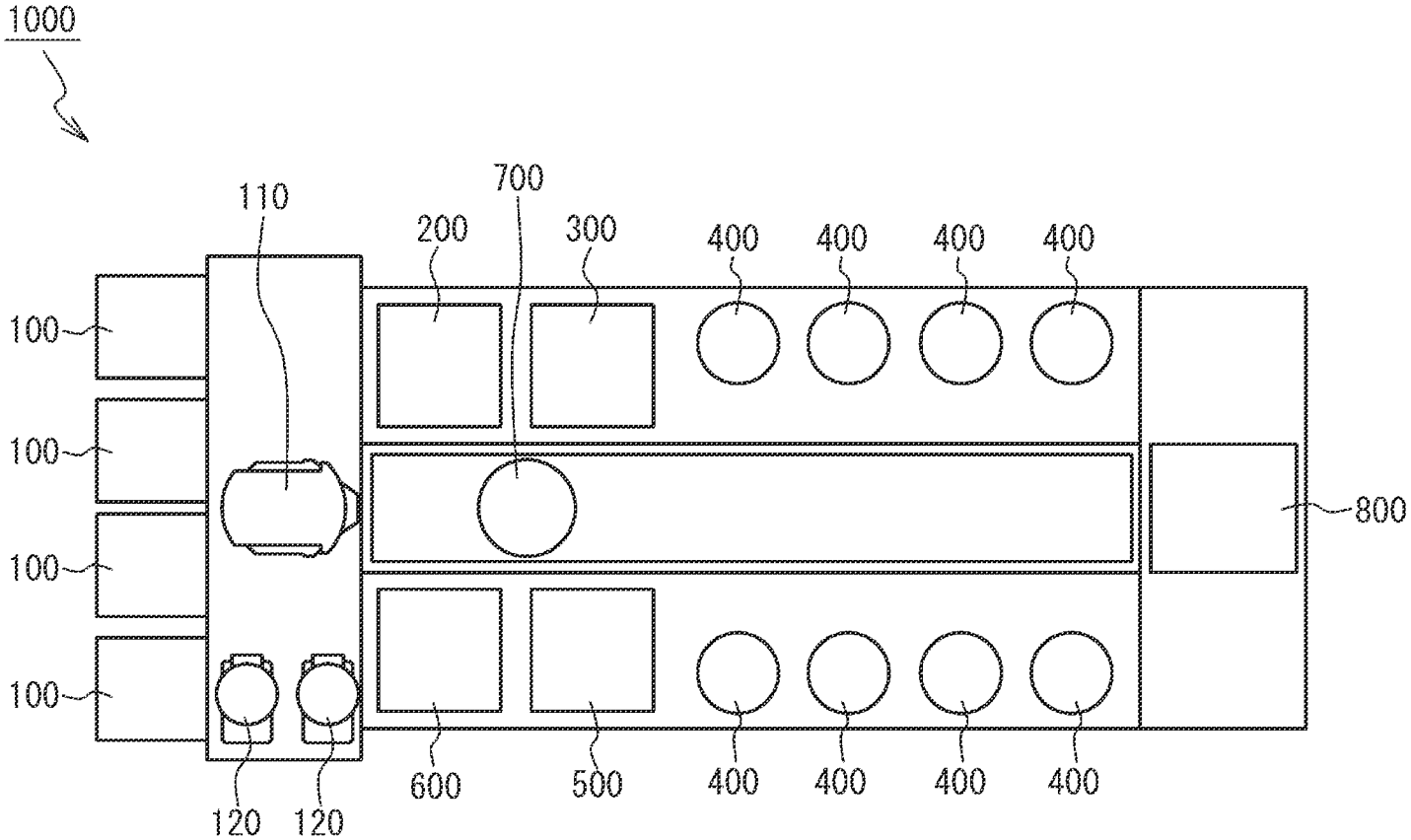
FIG. 2 is a plan view illustrating the overall configuration of the plating apparatus according to the embodiment.

FIG. 1 is a perspective view illustrating the overall configuration of a plating apparatus 1000 of this embodiment. FIG. 2 is a plan view illustrating the overall configuration of the plating apparatus 1000 of this embodiment. As illustrated in FIGS. 1 and 2, the plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in a vertical direction in this embodiment, the number of pre-wet modules 200 and arrangement of the pre-wet modules 200 are arbitrary.

For example, the pre-soak module 300 is configured to remove an oxidized film having a large electrical resistance present on a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers 600 are disposed to be arranged in the vertical direction in this embodiment, the number of spin rinse dryers 600 and arrangement of the spin rinse dryers 600 are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

Note that the configuration of the plating apparatus 1000 described in FIG. 1 and FIG. 2 is merely an example, and the configuration of the plating apparatus 1000 is not limited to the configuration in FIG. 1 and FIG. 2.

Subsequently, the plating module 400 will be described. Since the plurality of plating modules 400 included in the plating apparatus 1000 according to this embodiment have the identical configuration, one of the plating modules 400 will be described.

Figure 3:
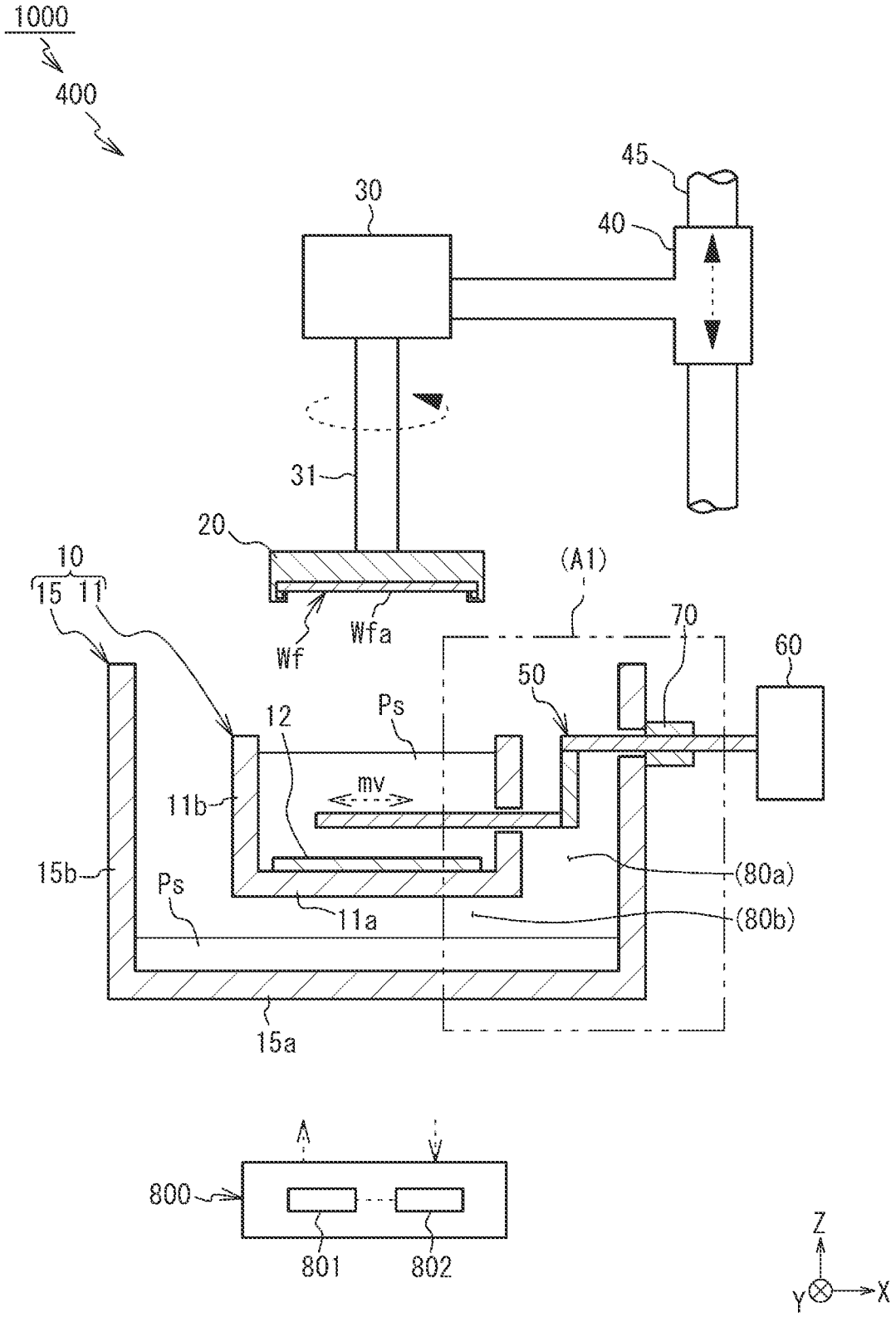
FIG. 3 is a schematic diagram for describing a configuration of a plating module of the plating apparatus according to the embodiment.
Figure 4:
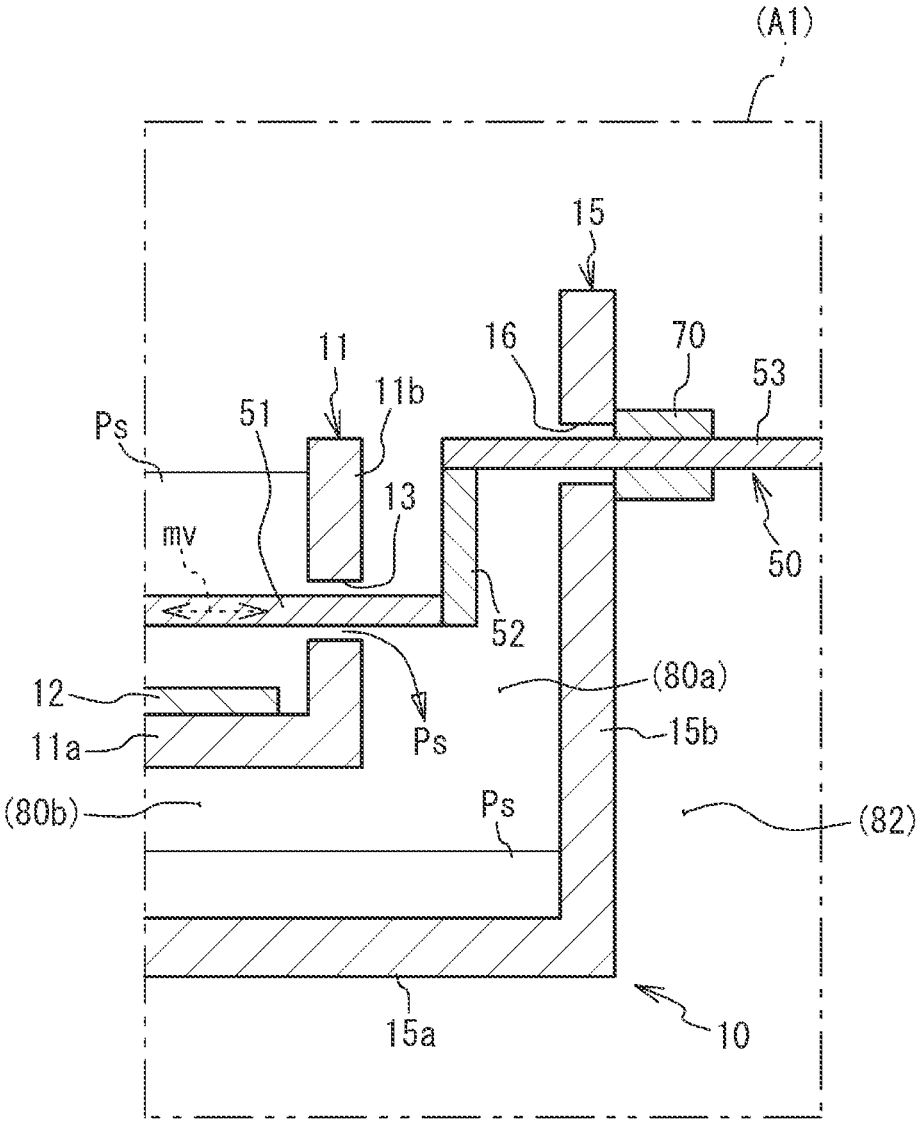
FIG. 4 is an enlarged cross-sectional view illustrating a part of the plating module according to the embodiment.
Figure 4:
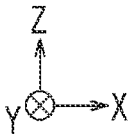

FIG. 3 is a schematic diagram for describing a configuration of the plating module 400 of the plating apparatus 1000 according to this embodiment. FIG. 4 is an enlarged cross-sectional view illustrating a part (A1 part in FIG. 3) of the plating module 400. The plating apparatus 1000 according to this embodiment is a cup type plating apparatus as an example. The plating module 400 of the plating apparatus 1000 according to this embodiment mainly includes a plating tank 10, a substrate holder 20, a rotation mechanism 30, an elevating mechanism 40, a paddle 50, a paddle driving mechanism 60, and a guiding member 70. Note that, in FIG. 3, respective cross-sectional surfaces of the plating tank 10, the substrate holder 20, the paddle 50, and the guiding member 70 are schematically illustrated.

The plating tank 10 according to this embodiment has a double tank structure as an example. Specifically, the plating tank 10 includes an inner tank 11 and an outer tank 15 arranged outside the inner tank 11. The inner tank 11 has a bottom wall 11*a*, and an outer peripheral wall 11*b* extending upward from an outer peripheral edge of the bottom wall 11*a*. The outer peripheral wall 11*b* is open at the top. The inner tank 11 internally accumulates a plating solution Ps. The inner tank 11 is secured to an inside of the outer tank 15 via a holding member (not illustrated). The outer tank 15 has a bottom wall 15*a*, and an outer peripheral wall 15*b* extending upward from an outer peripheral edge of the bottom wall 15*a*. The outer peripheral wall 15*b* is open at the top.

Note that the bottom wall 11*a* of the inner tank 11 according to this embodiment has a circular shape in plan view as an example. On the other hand, the bottom wall 15*a* of the outer tank 15 according to this embodiment has a rectangular shape in plan view as an example. However, the shapes of the bottom wall 11*a* of the inner tank 11 and the bottom wall 15*a* of the outer tank 15 are not limited to these. For example, the bottom wall 11*a* of the inner tank 11 may have a shape other than a circular shape (such as a rectangular shape), and the bottom wall 15*a* of the outer tank 15 may have a shape other than a rectangular shape (such as a circular shape).

Furthermore, as illustrated in FIG. 4, the outer peripheral wall 11*b* of the inner tank 11 according to this embodiment is provided with a hole 13 for a first portion 51 of the paddle 50 described later to be inserted through. Specifically, the hole 13 according to this embodiment is configured of a through-hole. The hole 13 is provided in a place below an upper end of the outer peripheral wall 11*b* and above a lower end of the outer peripheral wall 11*b* to communicate with an inside and an outside of the outer peripheral wall 11*b*.

Furthermore, in this embodiment, as an example, the outer peripheral wall 15*b* of the outer tank 15 according to this embodiment is also provided with a hole 16 for a second portion 53 of the paddle 50 described later to be inserted through. Specifically, the hole 16 according to this embodiment is configured of a through-hole. The hole 16 is provided in a place below an upper end of the outer peripheral wall 15*b* and above a lower end of the outer peripheral wall 15*b* to communicate with an inside and an outside of the outer peripheral wall 15*b*.

However, the configuration of the outer tank 15 is not limited to this. For example, the outer tank 15 may be configured without the hole 16 in the outer peripheral wall 15*b*. In this case, for example, the second portion 53 of the paddle 50 described later may be arranged to pass above the outer peripheral wall 15*b* of the outer tank 15.

A space 80*a* is provided between the outer peripheral wall 11*b* of the inner tank 11 and the outer peripheral wall 15*b* of the outer tank 15. Furthermore, in this embodiment, a space 80*b* is also provided between the bottom wall 11*a* of the inner tank 11 and the bottom wall 15*a* of the outer tank 15. However, it is not limited to this configuration, and the space 80*b* need not be provided between the bottom wall 11*a* of the inner tank 11 and the bottom wall 15*a* of the outer tank 15 (that is, the bottom wall 11*a* of the inner tank 11 may be in contact with the bottom wall 15*a* of the outer tank 15).

It is only necessary for the plating solution Ps to be a solution that contains metallic element ions for constituting a plating film, and the specific examples are not particularly limited. In this embodiment, a copper plating process is used as an example of the plating process, and a copper sulfate solution is used as an example of the plating solution Ps. Furthermore, in this embodiment, the plating solution Ps contains a predetermined additive. However, it is not limited to this configuration, and the plating solution Ps may have a configuration that does not contain the additive.

An anode 12 is disposed inside the inner tank 11. Specific examples of the anode 12 are not particularly limited, and a soluble anode and an insoluble anode may be used. In this embodiment, an insoluble anode is used as the anode 12. Specific examples of the insoluble anode are not particularly limited, and platinum, iridium oxide, and the like may be used.

The substrate holder 20 is arranged above the anode 12 and holds a substrate Wf as a cathode. A lower surface Wfa of the substrate Wf corresponds to the surface to be plated. The substrate holder 20 is connected to a rotation shaft 31 of the rotation mechanism 30. The rotation mechanism 30 is a mechanism for rotating the substrate holder 20. As the rotation mechanism 30, a known mechanism, such as a motor, can be used. An elevating mechanism 40 is supported by a spindle 45 extending in the vertical direction. The elevating mechanism 40 is a mechanism for elevating the substrate holder 20 and the rotation mechanism 30 in the vertical direction. As the elevating mechanism 40, a known elevating mechanism, such as a linear motion type actuator, can be used. Operations of the rotation mechanism 30 and the elevating mechanism 40 are controlled by the control module 800.

When performing the plating process, the rotation mechanism 30 rotates the substrate holder 20, and the elevating mechanism 40 moves down the substrate holder 20, and immerses the substrate Wf in the plating solution Ps in the plating tank 10. Subsequently, an energization device (not illustrated) causes electricity to flow between the anode 12 and the substrate Wf. Thus, a plating film is formed on the lower surface Wfa of the substrate Wf.

An operation of the plating module 400 is controlled by the control module 800. The control module 800 includes a microcomputer. The microcomputer includes a Central Processing Unit (CPU) 801 as a processor, a storage section 802 as a non-transitory storage medium, and the like. In the control module 800, the CPU 801 operates based on commands of a program stored in the storage section 802 to control controlled sections (the rotation mechanism 30, the elevating mechanism 40, and the paddle driving mechanism 60) of the plating module 400.

The paddle 50 is a member configured to agitate the plating solution Ps accumulated in the inner tank 11 by reciprocating in the horizontal direction. The symbol "my" exemplified in FIG. 3 and FIG. 4 is an example of a reciprocating direction of the paddle 50. As illustrated in FIG. 4, the paddle 50 includes the first portion 51, the second portion 53, and a connecting portion 52. The first portion 51 and the second portion 53 are connected by the connecting portion 52.

The paddle 50 according to this embodiment is driven by the paddle driving mechanism 60 described later, and thereby reciprocates in an extending direction of the first portion 51 of the paddle 50 (that is, a long side direction (the X direction and the −X direction in the figures)) in the horizontal direction. However, the reciprocating direction of the paddle 50 is not limited to the directions exemplified in FIG. 3 and FIG. 4. As another example, the paddle 50 may reciprocate, for example, in a direction perpendicular to the extending direction of the first portion 51 (that is, a short side direction (the Y direction and the −Y direction in the figures)).

Figure 5:
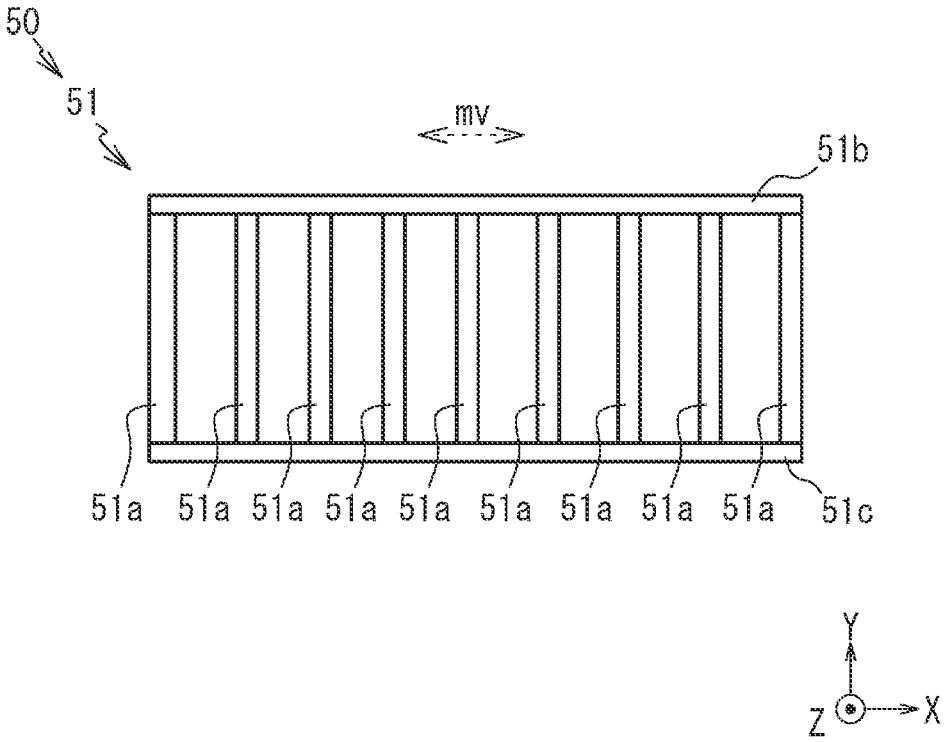
FIG. 5 is a schematic plan view of a first portion of a paddle according to the embodiment.

FIG. 5 is a schematic plan view of the first portion 51. With reference to FIG. 4 and FIG. 5, the first portion 51 is inserted through the hole 13 provided in the outer peripheral wall 11*b* of the inner tank 11, and is arranged to build a bridge between an inside of the inner tank 11 and an outside of the inner tank 11 (specifically, the space 80*a* in this embodiment). The first portion 51 is configured to agitate the plating solution Ps in the inner tank 11 by reciprocating in the horizontal direction.

Specifically, as illustrated in FIG. 5, the first portion 51 according to this embodiment has a ladder form in plan view. More specifically, the first portion 51 includes a plurality of agitating plates 51*a* extending in a direction perpendicular to a reciprocating direction of the first portion 51. End parts in the long side direction of the respective agitating plates 51*a* are joined by a coupling plate 51*b* and a coupling plate 51*c*. In a case where the first portion 51 reciprocates, the plating solution Ps is agitated by particularly the agitating plates 51*a* of the first portion 51. Note that the configuration in FIG. 5 is merely an example of the first portion 51, and the configuration of the first portion 51 is not limited to the configuration in FIG. 5.

With reference to FIG. 4, the second portion 53 is arranged outside the inner tank 11. Specifically, the second portion 53 according to this embodiment is arranged to build a bridge between the space 80*a* and an outer region 82 of the outer tank 15. More specifically, as an example, the second portion 53 according to this embodiment is inserted through the hole 16 provided in the outer peripheral wall 15*b* of the outer tank 15, and builds a bridge between the space 80*a* and the outer region 82 of the outer tank 15. The second portion 53 has an end portion projecting to the outer region 82, and the end portion is connected to the paddle driving mechanism 60. Furthermore, the second portion 53 is arranged above the first portion 51.

The connecting portion 52 is arranged outside the inner tank 11 (specifically, the space 80*a* in this embodiment) and connects an end portion of the first portion 51 to an end portion of the second portion 53. Specifically, the connecting portion 52 according to this embodiment extends in the vertical direction, and its lower end is connected to the end portion of the first portion 51 (the end portion on a side of the space 80*a*), while its upper end is connected to the end portion of the second portion 53 (the end portion on the side of the space 80*a*).

As illustrated in FIG. 3, the paddle driving mechanism 60 is a driving mechanism for reciprocating the paddle 50 in the horizontal direction. An operation of the paddle driving mechanism 60 according to this embodiment is controlled by the control module 800. The paddle driving mechanism 60 receives commands from the control module 800, and reciprocates the paddle 50 in the horizontal direction when performing the plating process on the substrate Wf (that is, during the plating process). As the paddle driving mechanism 60, for example, a paddle driving mechanism used in a known plating apparatus, such as a linear motion type actuator, can be used.

In this embodiment, when performing the plating process on the substrate Wf (that is, during the plating process), the inner tank 11 is supplied with the plating solution Ps from a plating solution supply device (not illustrated). With reference to FIG. 4, the plating solution Ps accumulated in the inner tank 11 is allowed to pass through a gap between the hole 13 and the first portion 51, and flow to the outside of the inner tank IL. Furthermore, the plating solution Ps in the inner tank 11 is also allowed to exceed the upper end of the outer peripheral wall 11*b* of the inner tank 11 and flow to the outside of the inner tank 11. During the plating process, an amount of the plating solution Ps accumulated in the inner tank 1 is adjusted such that a liquid surface of the plating solution Ps accumulated in the inner tank 11 is positioned above the first portion 51 of the paddle 50.

The plating solution Ps having flowed to the outside of the inner tank 11 is temporarily accumulated inside the outer tank 15. The plating solution Ps temporarily accumulated in the outer tank 15 is discharged to an outside of the outer tank 15 via a plating solution discharge port (not illustrated) disposed, for example, on the bottom wall 15*a* of the outer tank 15. The plating solution Ps discharged to the outside of the outer tank 15 is returned to the inside of the inner tank 11 again by the plating solution supply device. During the plating process, an amount of the plating solution Ps accumulated in the outer tank 15 is adjusted such that a liquid surface of the plating solution Ps temporarily accumulated in the outer tank 15 does not reach a position of the lower end of the connecting portion 52 of the paddle 50.

As illustrated in FIG. 4, the guiding member 70 is a member for guiding a reciprocation of the second portion 53 of the paddle 50 in the horizontal direction. Specifically, the guiding member 70 according to this embodiment is disposed on the outer tank 15. More specifically, the guiding member 70 according to this embodiment is disposed on a place around the hole 16 on an outer peripheral surface of the outer peripheral wall 15*b* of the outer tank 15. A through-hole for the second portion 53 of the paddle 50 to slide through is provided inside the guiding member 70. The second portion 53 of the paddle 50 slides through the through-hole to guide the reciprocation of the paddle 50.

The guiding member 70 is not an essential configuration for this embodiment, and the plating apparatus 1000 may have a configuration without the guiding member 70. However, compared with a case where the plating apparatus 1000 does not include the guiding member 70, a case where the plating apparatus 1000 does include the guiding member 70 is preferred since it facilitates a smooth reciprocation of the paddle 50.

A plating method according to this embodiment is achieved by the plating apparatus 1000 described above. That is, the plating method according to this embodiment is a plating method using the plating apparatus 1000, and includes the reciprocation of the paddle 50 in the horizontal direction when performing the plating process on the substrate Wf. Description of the plating method overlaps with the description of the plating apparatus 1000 described above and therefore is omitted.

With this embodiment described above, since the embodiment includes the paddle 50 as described above, for example, compared with a case where the connecting portion 52 and the second portion 53 of the paddle 50 are arranged inside the inner tank 11, a wave on the liquid surface of the plating solution Ps caused by the paddle 50 can be suppressed when the paddle 50 reciprocates. Accordingly, this ensures suppressing a liquid splash of the plating solution Ps.

Thus, since the liquid splash of the plating solution Ps can be suppressed, this embodiment ensures suppressed leaking to the outside of the outer tank 15 (outer region 82) due to the liquid splash of the plating solution Ps accumulated in the inner tank 11.

Furthermore, since the second portion 53 of the paddle 50 is positioned above the first portion 51, this embodiment ensures suppressing the plating solution Ps accumulated in the inner tank 11 traveling up to the second portion 53 after having travelled along the first portion 51. Accordingly, the embodiment ensures effectively suppressing the leaking to the outside of the outer tank 15 of the plating tank 10 by travelling of the plating solution Ps accumulated in the inner tank 11 along the paddle 50.

Furthermore, since the leaking of the plating solution Ps accumulated in the inner tank 11 to the outside of the outer tank 15 can be effectively suppressed as described above, this embodiment ensures suppressing the unnecessary consumption of the plating solution Ps. Furthermore, the embodiment also ensures suppressed corrosion and the like occurring in parts existing outside the outer tank 15 in the plating apparatus 1000 due to the leaking of the plating solution Ps to the outside of the outer tank 15.

As described above, while the details of the embodiments of the present invention have been described, the present invention is not limited to the specific embodiments, and various kinds of modifications and changes can further be made within the spirit of the present invention described in the claims.

For example, in the embodiment described above, the plating tank 10 is a double structure plating tank including the inner tank 11 and the outer tank 15, but it is not limited to this configuration. For example, the plating tank 10 need not include the outer tank 15.

REFERENCE SIGNS LIST

10 . . . plating tank
11 . . . inner tank
11*b* . . . outer peripheral wall
12 . . . anode
13 . . . hole
15 . . . outer tank
15*b* . . . outer peripheral wall
16 . . . hole
20 . . . substrate holder
50 . . . paddle
51 . . . first portion
52 . . . connecting portion
53 . . . second portion
70 . . . guiding member
400 . . . plating module
1000 . . . plating apparatus
Wf . . . substrate
Wfa . . . lower surface
Ps . . . plating solution

What is claimed is:

1. A plating apparatus comprising:

a plating tank configured to accumulate a plating solution inside the plating tank, the plating tank including an inner tank provided with an anode arranged inside the inner tank;

a substrate holder configured to hold a substrate as a cathode; and a paddle configured to agitate the plating solution accumulated in the inner tank by reciprocating in a horizontal direction, wherein the paddle is arranged to be inserted through a hole provided in an outer peripheral wall of the inner tank and to build a bridge between an inside of the inner tank and an outside of the inner tank, the paddle including a first portion configured to agitate the plating solution accumulated in the inner tank, a second portion arranged outside the inner tank and disposed above the first portion, and a connecting portion arranged outside the inner tank to connect the first portion to the second portion, the plating tank is a plating tank having a double tank structure further including an outer tank arranged outside the inner tank, a space is provided between the outer peripheral wall of the inner tank and an outer peripheral wall of the outer tank, the second portion is inserted through a hole provided in the outer peripheral wall of the outer tank, and forms a bridge between the space and an outer region of the outer tank, the connecting portion is arranged in the space, a second space is provided between a bottom wall of the inner tank and a bottom wall of the outer tank, and the plating apparatus is configured so that, during a plating process, the plating solution accumulated in the inner tank passes through a gap between the hole provided in the outer peripheral wall of the inner tank and the first portion and is accumulated in the second space.

2. The plating apparatus according to claim 1, wherein the outer tank is provided with a guiding member configured to guide a reciprocation of the second portion in the horizontal direction.

3. A plating method using the plating apparatus according to claim 1, the plating method comprising:

reciprocating the paddle in the horizontal direction when performing a plating process on the substrate.

* * * * *